US005934661A

United States Patent [19]

Kameyama

[11] Patent Number: 5,934,661

[45] Date of Patent: Aug. 10, 1999

[54] FRICTION PAPER-FEED METHOD AND APPARATUS CAPABLE OF PREVENTING PAPER-FEED FAILURE CAUSED BY SLIPPAGE

[75] Inventor: Kenji Kameyama, Isehara, Japan

[73] Assignee: Ricoh Co., Ltd., Tokyo, Japan

[21] Appl. No.: 08/808,426

[22] Filed: Feb. 28, 1997

[30] Foreign Application Priority Data

Feb. 28, 1996 [JP] Japan ..... 8-041658

[51] Int. Cl.[6] ..... B65H 5/22

[52] U.S. Cl. ..... 271/4.08; 271/4.1; 271/110; 271/258.03; 271/258.04; 271/270; 271/265.01

[58] Field of Search ..... 271/3.16, 3.17, 271/4.01, 4.02, 4.03, 4.08, 4.1, 10.02, 10.03, 10.11, 110, 111, 258.03, 258.04, 265.01, 266, 270

[56] References Cited

U.S. PATENT DOCUMENTS 5,391,009 2/1995 Stodder ..... 271/110
5,423,526 6/1995 Hasegawa ..... 271/110
5,464,204 11/1995 Suzuki ..... 271/110
5,465,949 11/1995 Yamada et al. ..... 271/110
5,563,686 10/1996 Beaufort et al. ..... 271/258.03
5,676,363 10/1997 Kishida et al. ..... 271/10.03

*Primary Examiner*—H. Grant Skaggs
*Attorney, Agent, or Firm*—Oblon, Spivak McClelland, Maier & Neustadt, P.C.

[57] ABSTRACT

A friction paper-feed apparatus and method used in an information processing apparatus such as a facsimile apparatus prevents a paper-feed failure caused by a slippage produced at a contact region between a friction paper-feed roller and a sheet of paper. The friction paper-feed roller is driven with at least one of a drive operation having a relatively long time length, another drive operation having a relatively short time length, or both of the relatively long time length and the relatively short time length. The friction paper-feed roller is controlled to execute a stop operation after each of the drive operations. The stop operation is also executed after repeating a driver operation for a number times so as to terminate an execution of paper transferring operation and to prevent a paper-feed failure.

30 Claims, 8 Drawing Sheets

FRICTION PAPER-FEED METHOD AND APPARATUS CAPABLE OF PREVENTING PAPER-FEED FAILURE CAUSED BY SLIPPAGE

BACKGROUND OF THE INVENTION

1. Field of the Invention

This invention relates to a paper-feed apparatus and method used in a facsimile apparatus, a copying apparatus, a printing apparatus, and the like, and more particularly to a friction paper-feed apparatus which is capable of preventing a paper-feed failure caused by a slippage made between a paper and a friction roller.

2. Discussion of the Background

A paper-feed function is an essential function in an information processing apparatus, such as, a facsimile apparatus, a copying apparatus, a printing apparatus, and so forth, wherein paper is handled as a medium for transferring information. A background art paper-feed apparatus applied in these conventional information processing apparatuses uses friction to transfer paper, and is therefore called a friction paper-feed apparatus.

The conventional friction paper-feed apparatus is widely known and used to transfer an original document for a reading operation of an apparatus having a reading function, such as, a facsimile apparatus, a copying apparatus, and so forth. As a basic configuration of the friction paper-feed apparatus for this case, the unit includes a paper input tray for holding the original document, a paper separation unit for separating a sheet of the original document to be transferred from other sheets of the original document, and a first friction paper-feed roller for transferring the separated sheet using friction. Further, the unit includes a first sensor for detecting a leading edge of the sheet to be transferred so as to determine a start time for a reading operation, a second friction paper-feed roller for further transferring the sheet during a time period of the reading operation, and a second sensor for detecting a trailing edge of the sheet to determine an end time of the reading operation.

Exemplary configurations of a friction feeding portion of the conventional friction paper-feed apparatus for transferring an original document for a reading operation are shown in FIGS. 8(*a*)–8(*c*). A type shown in FIG. 8(*a*) is called a "friction pad" apparatus and method, includes an input paper tray 201, sheets of an original document 202, a friction paper-feed roller 203, and a friction pad 204. In this configuration, a bottommost sheet of the original document 202 is pulled out by the friction paper-feed roller 203. This sheet then receives a pressure (i.e., a force), indicated by a letter F with an arrow in FIG. 8(*a*), from the friction pad 204 which increases friction between the friction paper-feed roller 204 and the sheet. Consequently, the friction paper-feed roller 204 of the friction pad method properly transfers a sheet of the original document in the reading operation.

Another conventional friction-feed device is shown in FIG. 8(*b*) and is called a friction roller apparatus and method and has a similar configuration to that in FIG. 8(*a*) except for a friction roller 304 which allows the friction paper-feed roller 303 to transfer a bottommost sheet and stops extra sheets attached to the bottommost sheet by stopping rotation by a function of a torque limiter. In this way, the friction paper-feed roller of the friction roller method can properly transfer a sheet of an original document for a reading operation.

Another conventional device is shown in FIG. 8(*c*) and is called a forward-and-reverse roller. This device has a similar configuration to that of FIG. 8(*b*) except for use of a forward-and-reverse roller 404 which normally rotates clockwise to feed a bottommost sheet and starts to rotate counter-clockwise when extra sheets are attached to the bottommost sheet, so that these extra sheets can be fed in reverse. In this way, the friction paper-feed roller of the forward-and-reverse roller can properly transfer a sheet of an original document for a reading operation.

The background art friction paper-feed apparatuses and methods are widely used to transfer blank paper for a printing operation of an apparatus having a printing function, such as, a facsimile apparatus, a copying apparatus, a printing apparatus, and so forth. A basic configuration for the friction paper-feed apparatuses for transferring a blank paper is similar to that of the above-mentioned units when used in a reading operation. More specifically, the units generally include a blank paper cassette for holding a large number of sheets of blank paper, a separation unit for separating one sheet of blank paper from the blank paper cassette, and a first friction paper-feed roller for transferring the separated sheet of blank paper using friction. Further, the units include a first sensor for detecting a leading edge of the sheet so as to determine a start time of a printing operation, a second friction paper-feed roller for further transferring the sheet during a time period of the printing operation, and a second sensor for detecting a trailing edge of the sheet so as to determine an end time of the printing operation.

Exemplary configurations of a friction feed portion of the above-mentioned friction paper-feed apparatus for transferring blank paper for a printing operation are shown in FIGS. 9(*a*)–9(*c*). As shown in FIG. 9(*a*), a friction pad device and method includes an input paper tray 501, sheets of an original document 502, a friction paper-feed roller 503, and a friction pad 504 including a spring for providing a pressure. In this configuration, a topmost sheet of the original document 502 is pulled out by the friction paper-feed roller 503 and then receives a pressure, indicated by a letter "F" and an arrow in FIG. 9(*a*), from the friction pad 504 increasing friction between the friction paper-feed roller 504 and the sheet. As a result, the friction paper-feed roller 504 can properly transfer blank paper for a printing operation.

As shown in FIG. 9(*b*), another friction roller and method has a similar configuration to that of FIG. 9(*a*) except for a friction roller 604 which allows the friction paper-feed roller 603 to transfer a topmost sheet and stops extra sheets attached to the topmost sheet by stopping rotation as a function of a torque limiter mounted in the friction roller 604. In this way, the friction paper-feed roller 603 of the friction roller method can properly transfer blank paper for a printing operation.

Another type is shown in FIG. 9(*c*) and is called a forward-and-reverse roller. This forward-and reverse roller has a similar configuration to that of FIG. 9(*b*) except a forward-and-reverse roller 704 is used and which normally rotates clockwise to feed a topmost sheet and starts to rotate counter-clockwise when extra sheets are attached to the topmost sheet, so that these extra sheets can be fed in reverse. In this way, the device of FIG. 9(*b*) using the friction paper-feed roller 703 can properly transfer blank paper for a printing operation.

Still another type of device which is capable of feeding a blank sheet from rolled paper using a friction paper-feed roller is similar to that mentioned above is also known as the friction paper-feed apparatus (not shown in the figures).

However, as identified by the present inventor, the above-mentioned configurations of the friction paper-feed method and apparatus for both the reading and printing operations share a common problem of a paper-feed failure caused by a slippage between a sheet of paper being transferred and a friction paper-feed roller. Specifically, such a paper-feed failure typically occurs when a sheet of paper is continuously transferred through a long and bending path. For example, an operation of transferring a sheet of paper in a reading operation of a facsimile apparatus may cause a paper-feed failure in a long and bending path, for example, between the paper tray and the position of the first sensor or the registration sensor. This slippage, as identified by the present inventor, is because frictional forces are produced at various regions, for example, between the sheet and an adjacent sheet, the sheet and four inside surfaces of the path, and so on, by the moving paper sheet, and, specifically, the friction at a bending or a narrowing portion in the path may become greater than one generated between the sheet and the friction paper-feed roller.

More specifically, frictional forces may usually occur at both top and bottom sides of a sheet of paper when a friction paper-feed roller transfers a topmost sheet from one of plural sheets of paper. One of the frictional forces may occur at the top side of the moving sheet as the friction paper-feed roller rotates while contacting the sheet. At the same time, another frictional force may occur at the bottom side of the moving sheet since the moving sheet contacts a top surface of an adjacent sheet. Therefore, the friction paper-feed roller is required to have a rougher surface, as compared with a surface of the adjacent sheet, so as to generate a frictional force with the top surface of the sheet greater than another frictional force generated at the bottom side of the sheet.

If frictional coefficients at the above-mentioned top and bottom sides of the sheet are represented by $\mu_1$ and $\mu_2$ respectively, the relationship between $\mu_1$ and $\mu_2$ is defined as $\mu_1$ and $\mu_2=0$ when the friction paper-feed roller is not driven. However, these frictional coefficients may change when the friction paper-feed roller starts to rotate. More specifically, in order to feed the sheet of paper, the relationship between $\mu_1$ and $\mu_2$ is required to become $\mu_1$ and $\mu_2>0$.

If the sheet thus starts to move and is then given a disturbing (opposing) force against such a movement by any accidental reason as mentioned below, the moving sheet may stop but still maintain contact with the rotating friction paper-feed roller. Such events tends to happen when the moving sheet goes into a bending or a narrowing portion, for example, of the transferring path. In these cases of slippage, the relationship between $\mu_1$ and $\mu_2$ changes into $\mu_2>\mu_1=0$.

Once the friction paper-feed roller begins to slip or a paper-feed failure occurs, it is difficult to make the roller re-grip the paper because the friction coefficient $\mu_1$ becomes null. As a result of the paper-feed failure, the sheet of the original document may be damaged in a serious manner since the friction paper-feed roller continues to rotate and rub the surface of the jammed sheet.

In addition, even if the jammed sheet is not damaged during the above-mentioned accidental slippage or a paper-feed failure, the surface of the jammed sheet may become relatively more smooth since the rotating friction paper-feed roller rubs a surface of the jammed sheet. In this case, $\mu_1$ becomes relatively smaller and the relationship between $\mu_1$ and $\mu_2$ may also change into $\mu_2>\mu_1>0$.

After that, the friction paper-feed roller may always slip on this particular sheet having a relatively smoother surface and cause a paper-feed failure during future operations.

As mentioned above, as determined by the present inventor, the cause of the paper-feed failure on the paper-feed apparatus using the friction paper-feed roller is a slippage which may bring about serious damage to an original document. In this circumstance, however, a problem is that there is no friction paper-feed apparatus which is capable of preventing, detecting, and recovering from a paper-feed failure so as to handle an original document in a secure manner.

SUMMARY OF THE INVENTION

Accordingly, an object of the present invention is to provide a novel friction paper-feed apparatus, used in a facsimile apparatus, a copying apparatus, a printing apparatus, and the like, which is capable of preventing a paper-feed failure caused by a slippage made between paper and a friction paper-feed roller.

Another object of the present invention is to provide a novel friction paper-feed apparatus which is capable of automatically detecting a slippage and recovering from the slippage.

Another object of the present invention is to provide a facsimile apparatus which includes the above-mentioned novel friction paper-feed apparatus.

Another object of the present invention is to provide methods of transferring a sheet of paper by the above-mentioned novel friction paper-feed apparatus.

The above objects of the present invention can be achieved by the inventive friction paper-feed apparatus and prevention method, where the present invention includes an input tray capable of holding at least one paper sheet, a sheet separator for separating one paper sheet from the input tray, and a sheet feeder for transferring the paper sheet separated by the sheet separator using a frictional force generated at a contact region between the sheet feeder and the paper sheet. Further, the paper sheet transferring apparatus includes a paper path for connecting the input tray and an exit portion of the paper sheet transferring apparatus and for forming a route through which the paper sheet is transferred by the sheet feeder, and a detector mounted at a predetermined position of the paper path, where the detector is for detecting the paper sheet when the paper sheet is transferred to the predetermined position.

The paper sheet transferring apparatus also includes a clock for counting (i.e., keeping) time, and a memory for storing data of a first predetermined time period normally appropriate to transfer the paper sheet to the predetermined position, a second predetermined time period normally appropriate to release the paper sheet from a pulling force by the transferring means, and a predetermined number. A sheet feeder driver is also included for performing a first drive operation of the sheet feeder for the first predetermined time period, a second drive operation for driving the sheet feeder so that the paper sheet is transferred at a predetermined speed until the paper sheet is ejected outside from the paper path, and a stop operation in which the sheet feeder driver stops driving the sheet feeder for the second predetermined time period. The paper sheet transferring apparatus further includes a counter for counting a number of times the first drive operation was performed (i.e., performance times). A controller is included for controlling the sheet feeder driver to perform the drive operation when at least one paper sheet is held in the input tray, bringing at least one of a first case where the detector detects a leading edge of the paper sheet during the first drive operation and a second case where the detector fails to detect the paper sheet in the first drive operation. In the second case, the controller controls the sheet feeder driver to repeat performing a set of the first drive operation and the stop operation until at least one of a time, referred to as a third case, that the detector detects the paper sheet unless the number of performance times counted by the counter becomes greater than the predetermined number of times stored in the memory and another time, referred to as a fourth case, that the number of performance times counted by the counter becomes greater than the predetermined number stored in the memory. In each event of the above-mentioned first and third cases, the controller further controls the sheet feeder driver to perform the stop operation and the second drive operation so that the paper sheet is subjected to a predetermined process of information processing. In an event of the above-mentioned fourth case, the controller generates a predetermined warning signal.

In the above-mentioned paper sheet transferring apparatus, one example of the paper sheet is an original document having an image thereon.

In the above-mentioned paper sheet transferring apparatus, one example of the paper sheet is a blank paper sheet for serving as paper on which to be printed in a printing apparatus.

In the above-mentioned paper sheet transferring apparatus, one example of the sheet feeder is a rotatable roller.

In the above-mentioned paper sheet transferring apparatus, one example of the sheet feeder driver is a stepping motor and an example operation of the controller is to inhibit an excitation current to the stepping motor during the stop operation so that the paper sheet becomes free from a force from the stepping motor through the roller.

In the above-mentioned paper sheet transferring apparatus, a length of the first drive operation is relatively short so that a plurality of times of the first drive operation is normally required to transfer the paper sheet to the predetermined position.

In the above-mentioned paper sheet transferring apparatus, a time length (duration) of the stop operation is adjustable by a user into at least one of a mode in which the time length is set as the user desires and a mode in which the time length automatically varies from time to time.

A facsimile apparatus according to the present invention includes the inventive friction paper-feed apparatus with a paper sheet transferring apparatus which includes an input tray capable of holding at least one sheet of an original document, a sheet separator for separating one sheet of the original document from the input tray, and a sheet feeder for transferring the sheet separated by the sheet separator using a frictional force generated at a contact region between the sheet feeder and the sheet. Further, the above-mentioned facsimile apparatus includes a paper path for connecting the input tray and an exit portion of the paper sheet transferring apparatus of the facsimile apparatus and for forming a route through which the sheet is transferred by the sheet feeder, and a detector mounted on a predetermined position of the paper path for detecting the sheet when the sheet is transferred to the predetermined position.

The above-mentioned facsimile apparatus also includes a clock for counting time, a memory for storing data of a first predetermined time period normally appropriate to transfer the sheet to the predetermined position, a second predetermined time period normally appropriate to release the sheet from a pulling force by the sheet feeder, and a predetermined number. A sheet feeder driver is included for performing a first drive operation in which the sheet feeder driver drives the sheet feeder for the first predetermined time period, a second drive operation in which the sheet feeder driver drives the sheet feeder so that the sheet is transferred at a predetermined speed until the sheet is ejected from the paper path, and a stop operation in which the sheet feeder driver stop driving the sheet feeder for the second predetermined time period, and a counter for counting a number of times the first drive operation is performed. The facsimile apparatus further includes a controller for controlling the sheet feeder driver to perform the drive operation when at least one sheet of the original document is held in the input tray, bringing at least one of a first case such that the detector detects a leading edge of the sheet during the first drive operation and a second case such that the detector fails to detect the sheet in the first drive operation. In the above-mentioned second case, the controller further controls the sheet feeder driver to repeat performing a set of the first drive operation and the stop operation until at least one of a time, referred to as a third case, that the detector detects the sheet unless the number of performance times counted by the counter becomes greater than the predetermined number of times stored in the memory and a time, referred to as a fourth case, that the number of performance times counted by the counter becomes greater than the predetermined number stored in the memory. In each event of the above-mentioned first and third cases, the controller further controls the sheet feeder driver to perform the stop operation and the second drive operation and so that the paper sheet is subjected to a predetermined process of information processing. In an event of the fourth case, the controller generates a predetermined warning signal.

A method of transferring a paper sheet by the above-mentioned paper sheet transferring apparatus includes steps of detecting an existence of at least one paper sheet in an input paper tray, separating one paper sheet from the input tray, and activating a sheet feeder to transfer the separated paper sheet through a paper path for connecting the input tray and an exit portion of the paper sheet transferring apparatus and for forming a route through which the paper sheet is transferred by the sheet feeder, using a frictional force generated at a contact region between the sheet feeder and the paper sheet.

Further, the above-mentioned method of transferring a paper sheet by the paper sheet transferring apparatus includes steps of detecting the paper sheet when the paper sheet is transferred to a predetermined position by a detector mounted on the predetermined position of the paper path. Also included are steps of counting time by a clock, and storing data of a first predetermined time period normally appropriate to transfer the paper sheet to the predetermined position, a second predetermined time period normally appropriate to release the paper sheet from a pulling force by the transferring means, and a predetermined number into a memory. Further, the method includes steps of activating a sheet feeder driver to perform a first drive operation in which the sheet feeder drives the sheet feeder for the first predetermined time period, a second drive operation in which the sheet feeder drives the sheet feeder so that the paper sheet is transferred at a predetermined speed until the paper sheet is ejected outside from the paper path, and a stop operation in which the sheet feeder driver stops driving the sheet feeder for the second predetermined time period, and counting a number of performance times of the first drive operation by a counter.

Further, the above-mentioned method of transferring a paper sheet by the paper sheet transferring apparatus includes steps of controlling the sheet feeder driver to perform the drive operation when at least one paper sheet is held in the input tray, bringing at least one of a first case such that the detector detects a leading edge of the paper sheet during the first drive operation and a second case such that the detector fails to detect the paper sheet in the first drive operation.

In the above-mentioned second case, additional steps include controlling the sheet feeder driver to repeat performing a set of the first drive operation and the stop operation until at least one of a time, referred to as a third case, that the detector detects the paper sheet unless the number of performance times counted by the counter becomes greater than the predetermined number of times stored in the memory and a time, referred to as a fourth case, that the number of performance times counted by the counter becomes greater than the predetermined number stored in the memory.

In each event of the above-mentioned first case and third cases, the above-mentioned method of transferring a paper sheet by the paper sheet transferring apparatus further includes steps of controlling the sheet feeder driver to perform the stop operation and the second drive operation so that the paper sheet is subjected to a predetermined process of information processing. In an event of the above-mentioned fourth case, the above-mentioned method of transferring a paper sheet by the paper sheet transferring apparatus further includes steps of generating a predetermined warning signal.

In the above-mentioned method of the paper sheet transferring apparatus, one example of the paper sheet is the original document having an image thereon.

In the above-mentioned method of the paper sheet transferring apparatus, one example of the paper sheet is a blank paper sheet for serving as paper to be printed on a printing apparatus.

In the above-mentioned method of the paper sheet transferring apparatus, one example of the sheet feeder is a rotatable roller.

In the above-mentioned method of the paper sheet transferring apparatus, one example of the sheet feeder driver is a stepping motor and an example operation of the controller is to inhibit an excitation current to the stepping motor during the stop operation so that the paper sheet becomes free from a force from the stepping motor through the roller.

In the above-mentioned method of the paper sheet transferring apparatus, a length of the first drive operation is relatively short so that a plurality of times of the first drive operation is normally required to transfer the paper sheet to the predetermined position.

In the above-mentioned method of the paper sheet transferring apparatus, a time length of the stop operation is adjustable by a user into at least one of a mode in which the time length is set as the user desires and a mode in which the time length automatically varies from time to time.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
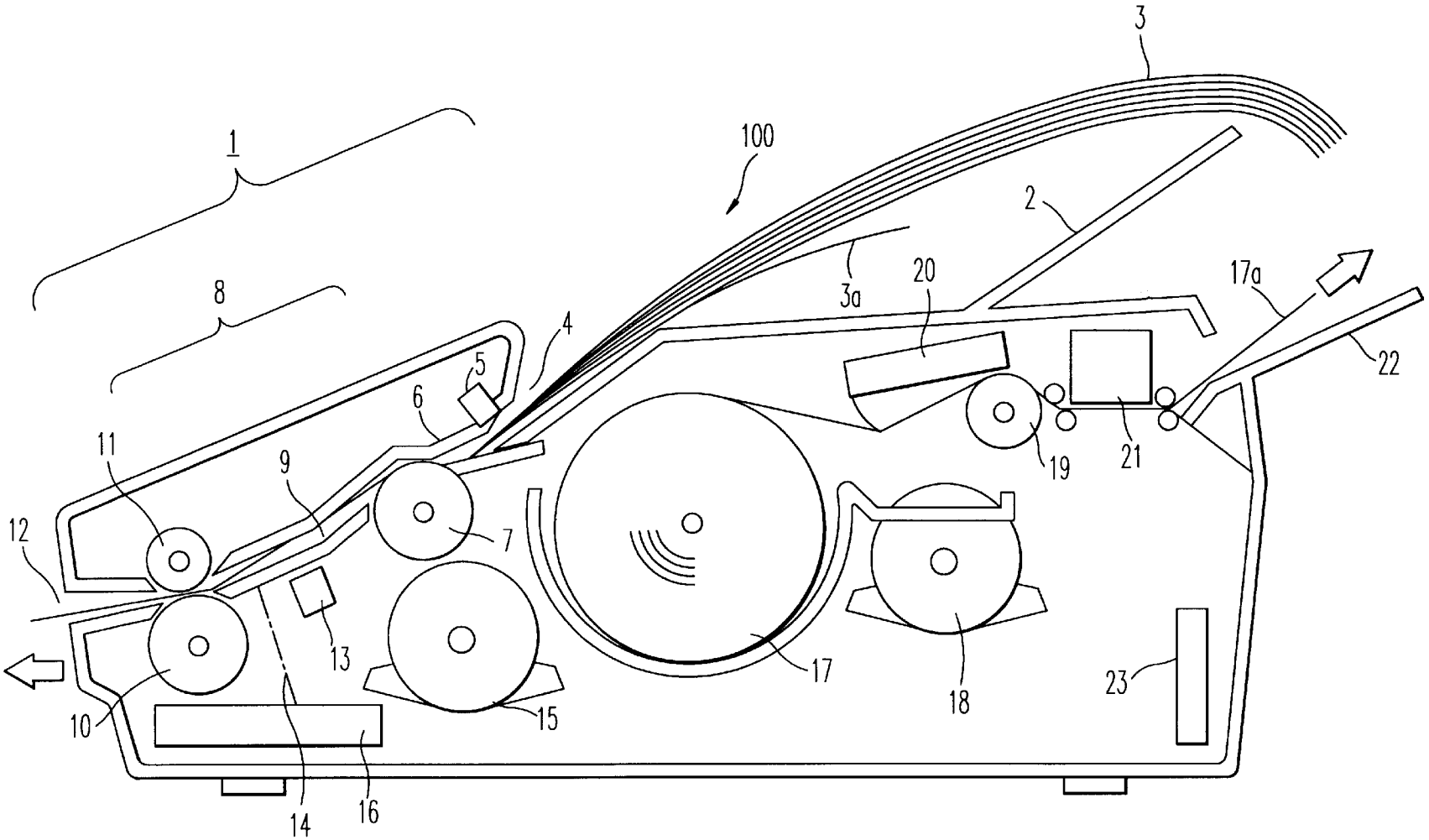
FIG. 1 is a sectional side view of an exemplary facsimile apparatus which includes an embodiment of a friction paper-feed apparatus according to the present invention.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Referring now to the drawings, wherein like reference numerals designate identical or corresponding parts throughout the several views, and more particularly to FIG. 1 thereof, there is illustrated a sectional side view of an exemplary facsimile apparatus 100 in which an embodiment of a friction paper-feed apparatus 1 according to the present invention is provided.

The exemplary facsimile apparatus 100 includes the friction paper-feed apparatus 1 for transferring an original document in a reading operation as shown in FIG. 1. The facsimile apparatus 100 further includes an input paper tray 2 for holding at least one sheet of an original document 3, an original document entrance portion 4 for receiving the original document 3, and an original document detector 5 for detecting an existence of the original document 3. Further, the facsimile apparatus 100 includes a sheet separation portion 6 for separating a bottommost sheet from the original document 3, one sheet by one sheet.

The facsimile apparatus 100 further includes a first friction paper-feed roller 7 for transferring a sheet 3*a* separated from the original document 3 by the sheet separation portion 6. A sheet transferring portion 8 is shown next to the friction paper-feed roller 7 and includes a sheet transferring path 9 connected to a region between a second friction paper-feed roller 10 and an idle roller 11, for transferring the sheet 3*a* to an exit 12. Through this exit 12, the sheet 3*a* is ejected to the direction indicated by an arrow in FIG. 1. The facsimile apparatus 100 includes a sensor unit 13 near a scanning position 14 in the sheet transferring path 9 for detecting the sheet 3*a* transferred by the first friction paper-feed roller 7.

A paper-feed motor 15 is included for driving the first friction paper-feed roller 7 and the second friction paper-feed roller 10. Further, the facsimile apparatus 100 includes an optical scanning unit 16 including mirrors, a lens, a CCD (charge coupled device), and so on for reading an image of the sheet 3*a*. A roll of paper 17 is included as shown for serving as print paper, along with a platen drive motor 18, a platen 19, and a thermal print unit 20. A paper cutting unit 21, an output paper tray 22, and a control unit 23 are included as shown for controlling an entire operation of the novel facsimile apparatus 100.

The platen drive motor 18 drives the platen 19 to pull out a sheet 17*a* from the above-mentioned roll of paper 17. The thermal print unit 20 prints an image, sent from other facsimile apparatus, on the sheet 17*a* which is then ejected in the direction indicated by an arrow in FIG. 1 and is placed onto an output paper tray 22.

Figure 2:
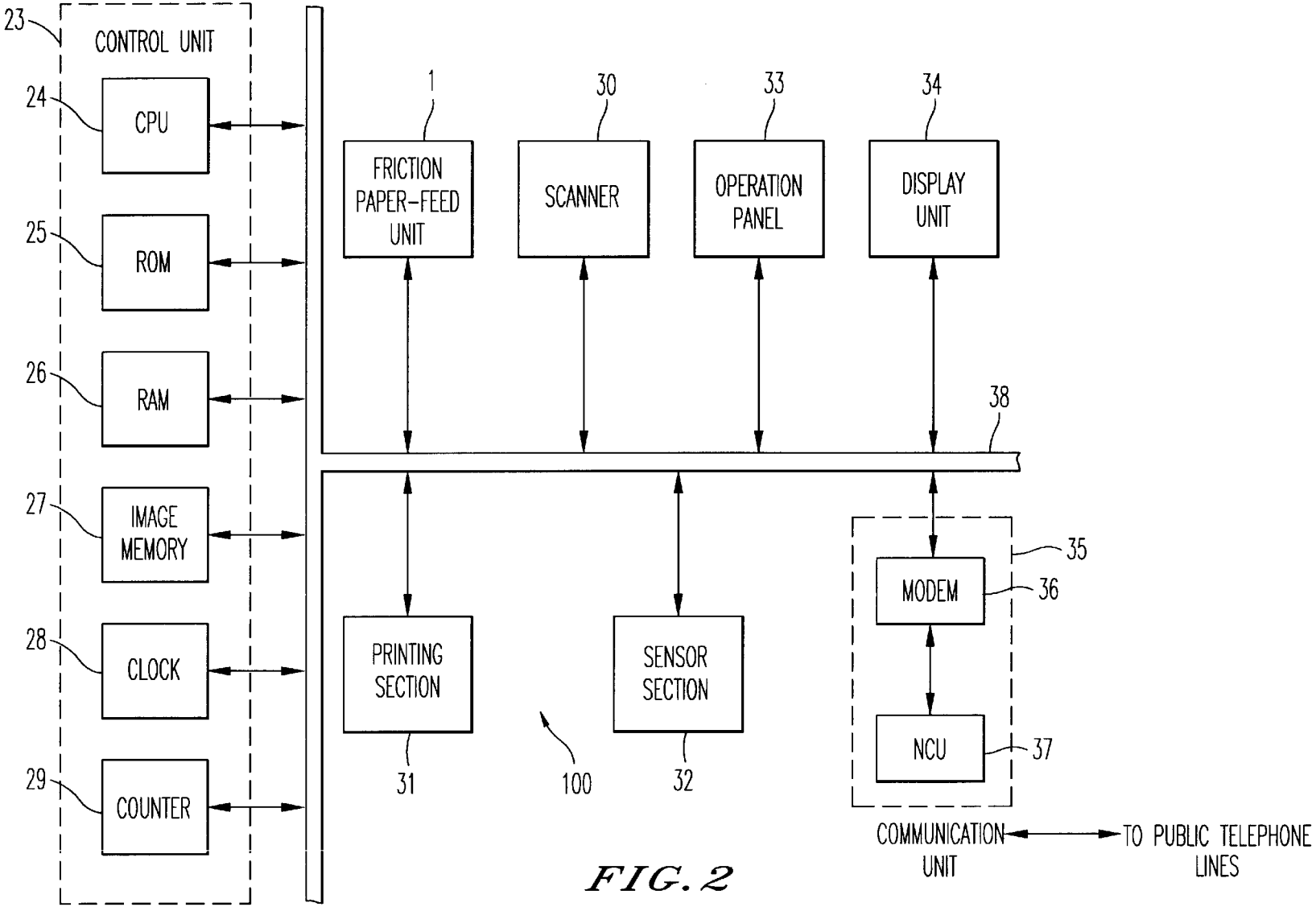
FIG. 2 is a functional block diagram of the facsimile apparatus shown in FIG. 1.

FIG. 2 shows a functional block diagram of the above-mentioned exemplary facsimile apparatus 100 which includes the novel friction paper-feed apparatus 1 for transferring an original document for a reading operation. As illustrated, the control unit 23 in this functional block diagram includes a CPU 24, a ROM 25 for storing a program, a RAM 26 for serving as a work area, an image memory 27 for storing a received image and an image to be transferred, a clock 28, and a counter 29 for counting a number paper-feed operations that have been performed.

The block diagram shown in FIG. 2 further indicates the friction paper-feed apparatus 1, a scanner 30 wherein the optical scanning unit 16 and so forth shown in FIG. 1 are included, and a printing section 31 wherein the platen drive motor 18, the platen 19, the thermal printing unit 20, and so forth shown in FIG. 1 are included. The block diagram shown in FIG. 2 further indicates a sensor section 32 wherein the original document detector 5 and the sensor unit 13 shown in FIG. 1 are included, an operation panel 33, and a display unit 34. Further, the block diagram shown in FIG. 2 indicates a communication unit 35 which includes a modem 36 and an NCU (network control unit) 37 and interfaces with a PSTN (public switched telephone network), an ISDN (integrated services digital network), and/or the like. FIG. 2 indicates the use of a system bus line 38 for interconnecting all the elements described above in an exemplary manner as shown in FIG. 2.

Under control of the control unit 23, the friction paper-feed apparatus 1 transfers a sheet 3*a* separated from the original document 3, the scanner 30 reads an image of a sheet 3*a* separated from the original document 2, and the printing section 31 prints an image sent from other facsimile apparatus or the like through the image memory 27. The sensor section 32 detects an existence of the original document 3, leading and trailing edges of the transferred sheet 3*a*, so as to determine various event times such as a start time of a reading operation, as an example. The operation panel 33 receives instructions, such as a scan-start for starting scanning the sheet 3*a*, for example, entered by an operator. The display unit 34 displays various status information of the facsimile apparatus 100, such as an error status indicating what kind of error is produced, as an example. The communication unit 34 interfaces with public telephone lines such as a PSTN (public switched telephone network), an ISDN (integrated services digital network), or other communications resource.

As mentioned, an operation of transferring a sheet of paper in a reading operation of a facsimile apparatus may cause a paper-feed failure in a long and bending path, for example, between the paper tray and the position of the first sensor or the registration sensor mounted on the sheet transferring path. In order to control a sheet transferring operation in this region of the path of the friction paper-feed apparatus, the paper-feed motor 15 (FIG. 1) is controlled so as to alternately effect a driving operation and a stop operation.

As an example of a sheet transferring operation, an execution of one long time driving operation may successfully carry out transferring a sheet 3*a* from the paper tray to the registration position without a slippage. However, when the operation is not successful, slippage may be the cause. Therefore, after securely executing a stop operation, another execution of the driving operation may succeed to transfer the sheet 3*a* to the registration position.

As another example of a sheet transferring operation, an execution of a number of short time driving operations may successfully carry out transferring a sheet 3*a* from the paper tray to the registration position.

As another example of a sheet transferring operation, an execution of a combination of various different time driving operations may successfully carry out transferring a sheet 3*a* from the paper tray to the registration position.

In order to make these events possible, the RAM 26 is arranged to store various predetermined time periods selectable by a user each for defining a length of the driving operation in which the paper-feed motor 15 is continuously excited to transfer the sheet 3*a* or the stop operation in which the paper-feed motor 15 is kept off the power. The RAM 26 is also arranged to store a predetermined number to be referred as how many times a set of the successive driving and stop operations are repeated without a paper-feed failure as a result.

Figure 3:
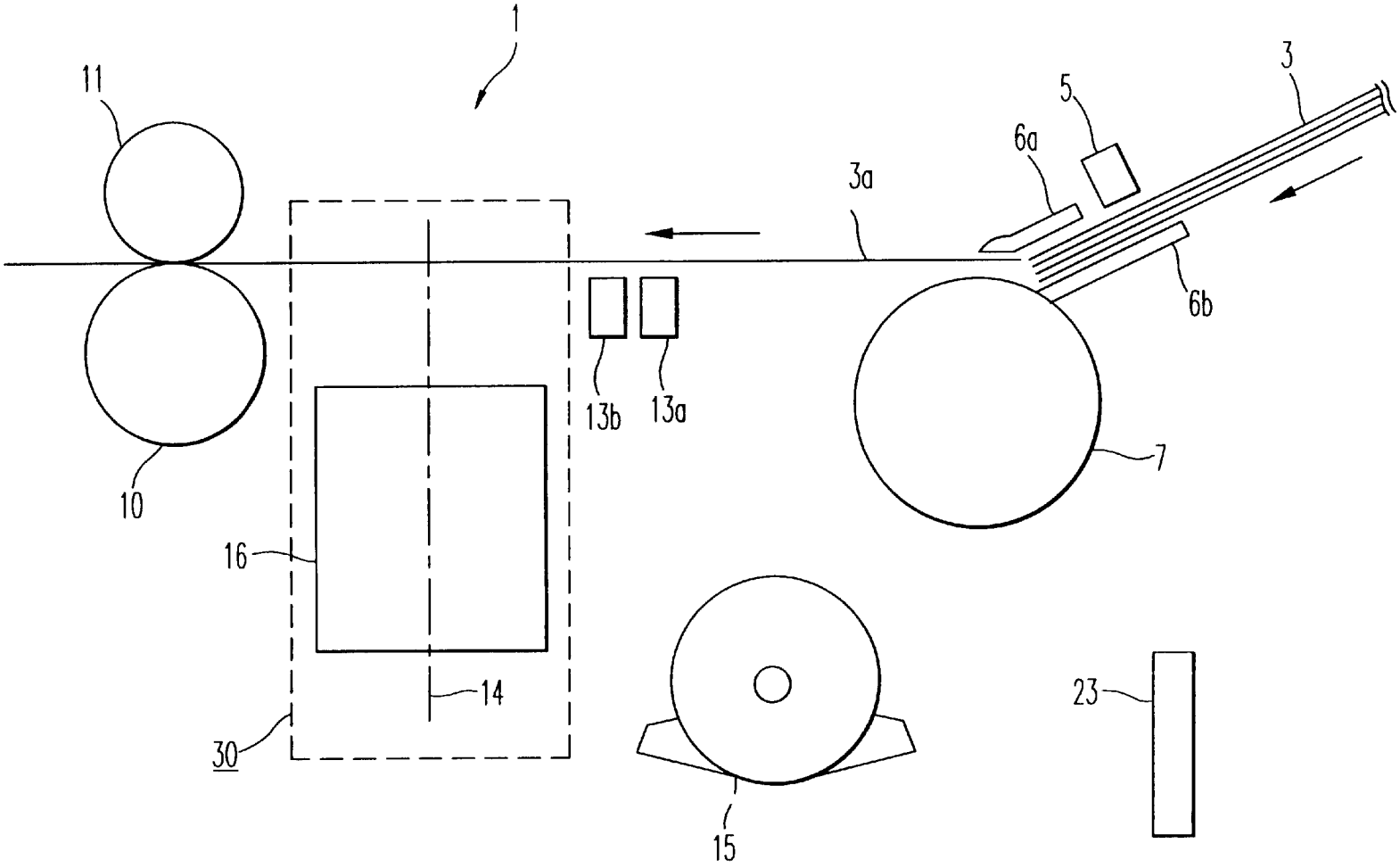
FIG. 3 is a detailed illustration of the friction paper-feed apparatus according to the present invention.

Next, an exemplary configuration of the friction paper-feed apparatus 1 for transferring an original document for a reading operation in a facsimile apparatus 100 is explained with reference to FIG. 3 illustrating major elements of the friction paper-feed apparatus 1 and the scanner 30. In FIG. 3, elements similar to those previously described with reference to FIGS. 1 and 2 are denoted by the same reference numerals.

The friction paper-feed apparatus 1 shown in FIG. 3 includes the original document 3, the sheet 3*a* separated from the original document, the original document detector 5, separation pads 6*a* and 6*b*, the first friction paper-feed roller 7, the second friction paper-feed roller 10, and the idle roller 11. Further, the friction paper-feed apparatus 1 shown in FIG. 3 includes a leading edge detector 13*a* for detecting a leading edge of the sheet 3*a*, a trailing edge detector 13*b* for detecting a trailing edge of the sheet 3*a*. Reference numeral 14 in FIG. 3 denotes a scanning line. Further, the friction paper-feed apparatus 1 shown in FIG. 3 includes the paper-feed motor 15, the optical scanning unit 16, and the scanner 30.

Next, how the sheet 3*a* of the original document 3 is transferred in a reading operation of the facsimile apparatus 100 including an embodiment of the friction paper-feed apparatus 1 is explained with reference to FIGS. 4 and 5(*a*)–5(*b*).

The process begins with a user placing an original document on the input paper tray 2 in Step S1, and then the CPU 24 of the controller 23 checks in Step S2 whether or not the original document detector 5 detects the original document. If the response is YES in Step S2, the process proceeds to step S3 where the CPU instructs the paper-feed motor 15 to drive the first friction paper-feed roller 7 to start rotation. In response, the first friction paper-feed roller 7 grips a leading edge of a bottommost sheet 3*a* of the original document 3. At this time, the bottommost sheet 3*a* may inadvertently bring with it a number of adjacent sheets as a result of frictional forces between the respective sheets.

However, the separation pads 6*a* and 6*b* (see, e.g., FIG. 3) assert tension onto the original document 3 so as to help the bottommost sheet 3*a* separate from the original document 3 to increase friction between the sheet 3*a* and the first friction paper-feed roller 7 so that the sheet 3*a* alone can be transferred into the original document transferring path 9. Once separated, the sheet 3*a* is transferred for a first predetermined time period $T_1$. The first predetermined time period $T_1$ is set on the basis of an appropriate time in which the first friction paper-feed roller 7 can transfer the sheet 3*a* to such a position that a leading edge of the sheet 3*a* is detected by the leading edge detector 13*a*.

The controller 23 starts an operation of reading an image of the sheet 3*a* upon detecting the leading edge of the sheet 3*a* within the first predetermined time period $T_1$. More specifically, the CPU 24, in Step S4, checks whether or not the leading edge detector 13*a* detects the leading edge of the sheet 3*a*. If the response in Step S4 is NO, the CPU 24 in Step S5 checks whether or not the first predetermined time period $T_1$ is passed. Then, if the response in Step S5 is NO, the CPU 24 repeats Step S5 until the first predetermined time period $T_1$ is passed. When a result of Step S5 becomes YES, the CPU in Step S6 instructs the paper-feed motor 15 to stop the first friction paper-feed roller 7. After that, in Step S7, the CPU 24 again checks whether or not the leading edge detector 13*a* detects the leading edge of the sheet 3*a*.

If the response to Step S7 is YES, the process proceeds to Step S8 where the CPU 24 instructs the scanner 30 to read the sheet 3*a* and the paper-feed motor 15 to drive the first friction paper-feed roller 7 to restart rotating so as to further feed the sheet 3*a*. During a time of the reading operation, a driving roller of the sheet 3*a* is switched from the first friction paper-feed roller 7 to the second friction paper-feed roller 10 upon a time that the leading edge of the sheet 3*a* reaches the second friction paper-feed roller 10.

The process then proceeds to Step S9 where the CPU 24 checks whether or not the trailing edge detector 13*b* detects a trailing edge of the sheet 3*a*. If the response in Step S9 is NO, the CPU 24 repeats the check of Step S9. However, when the trailing edge detector 13*b* detects the trailing edge of the sheet 3*a*, a result of Step S9 becomes YES and thus, in Step S10, the CPU 24 thereby finishes the reading operation and controls the second friction paper-feed roller 10 to rotate so as to eject the sheet 3*a* to the exit 12 shown in FIG. 1. Then, the process ends.

In this way, the friction paper-feed apparatus 1 mounted in the facsimile apparatus 100 can properly transfer the sheet 3*a* of the original document 3 within an appropriate time period $T_1$ when the sheet 3*a* is transferred from the input paper tray 2 to the registration position or the position of the leading edge detector 13*a* without a slippage between the sheet 3*a* and the first friction paper-feed roller 7.

Figure 4:
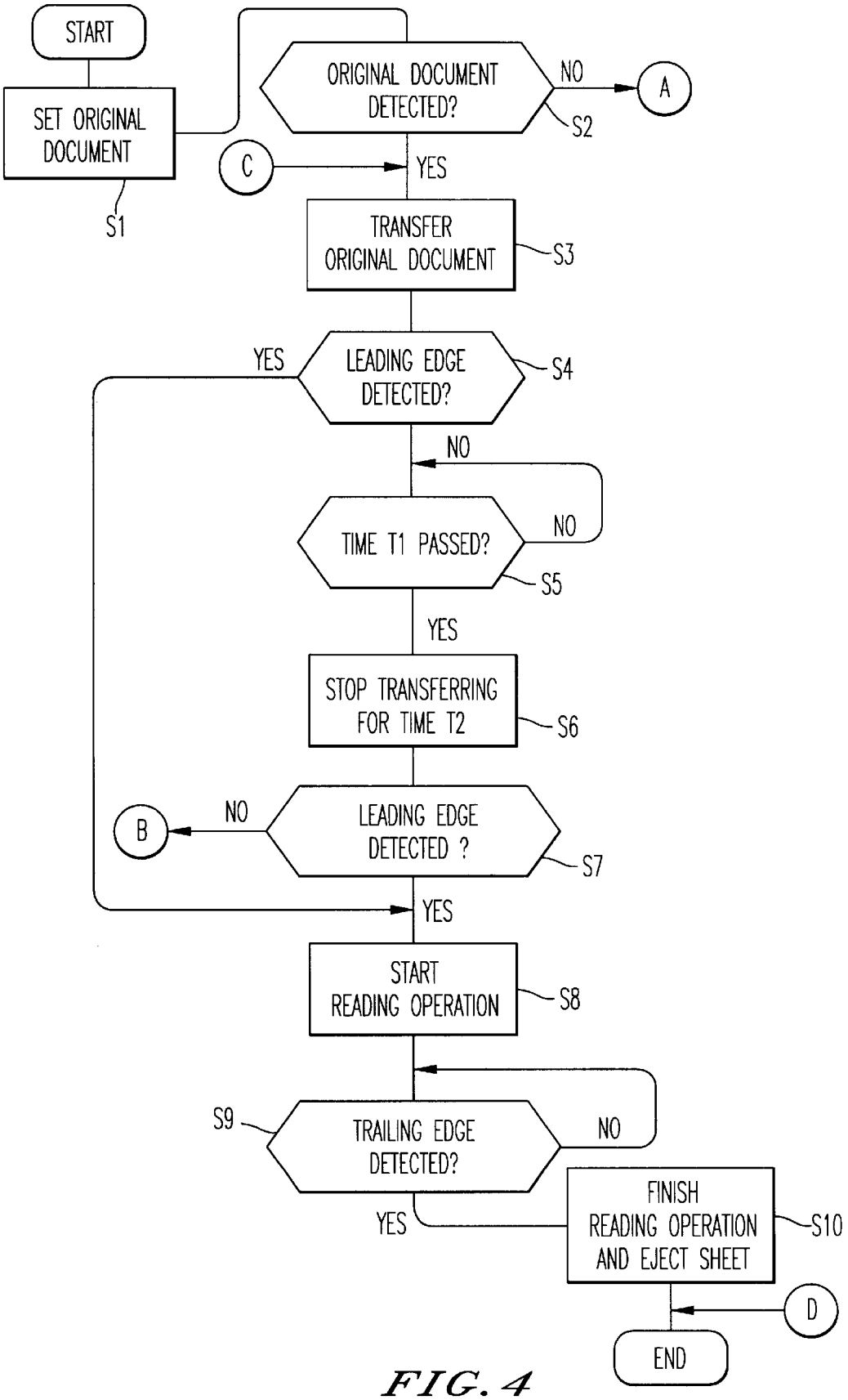
FIGS. 4 is a flowchart of a main process performed by the friction paper-feed apparatus according to the present invention for preventing, detecting, and recovering from slippage.
Figure 5A:
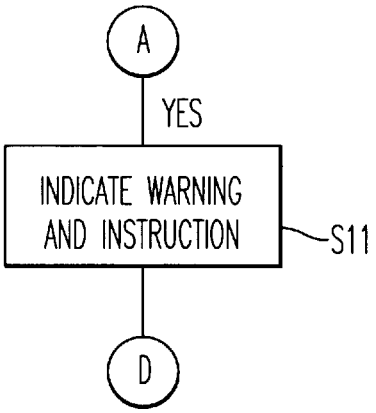
FIGS. 5(*a*)–5(*b*), are flowcharts that continue from the main flowchart shown in FIG. 4.
Figure 5B:
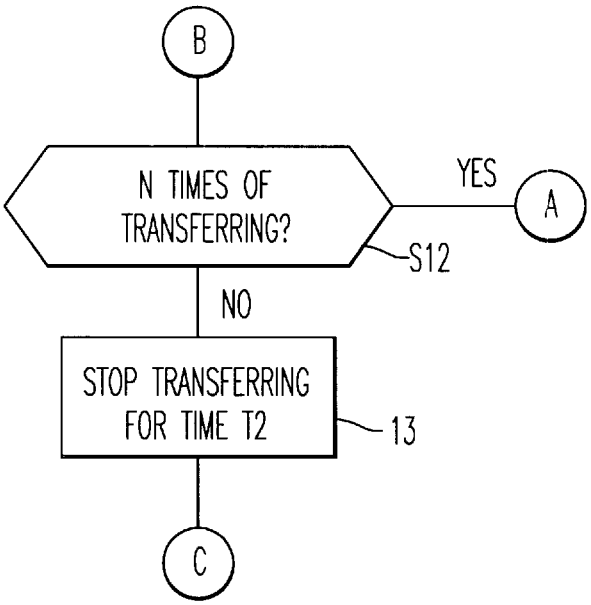

When the original document 3 is not detected in Step S2, the CPU 24 determines that an abnormal event occurs and the process flows to Step S11, which is shown in FIG. 5(*a*), and is illustrated as "A" in FIG. 4. In Step S11 the CPU 24 instructs the display unit 34 to display a warning and an instruction for a user to take an appropriate action such as checking and resetting the original document 3 in the input paper tray 2. Then, the process returns to the main flow diagram as is illustrated by the symbol "D" in FIGS. 4 and 5(*a*). Subsequently, the process ends.

If the leading edge is detected in Step S4 so that the response to the inquiry in Step S4 is YES, the process flows to Step S8 so as to immediately start the reading operation.

Furthermore, if the leading edge is detected or the response in Step S7 is NO as shown in FIG. 4, the CPU 24, in Step S12 in FIG. 5(*b*), checks whether or not a number of repeat times of the transferring operation becomes greater than a predetermined number of times stored in the RAM 26. If the response to the inquiry in Step S12 is YES, the CPU 24 determines that an abnormal event occurs and the process flows to Step S11 shown in FIG. 5(*a*) as the symbol "A". Subsequently, in Step S11 the CPU 24 instructs the display unit 34 to display a warning and an instruction for a user to take an appropriate action such as checking and resetting the original document 3 in the input paper tray 2. Then, the process is ends.

If the response to the inquiry in Step S12 is NO, the process proceeds to Step S13 where the CPU 24 instructs the paper-feed motor 15 to stop the first friction paper-feed roller 7 for the second predetermined time period $T_2$. Subsequently, the process proceeds to Step S3 so as to repeat the transferring operation.

Figure 6:
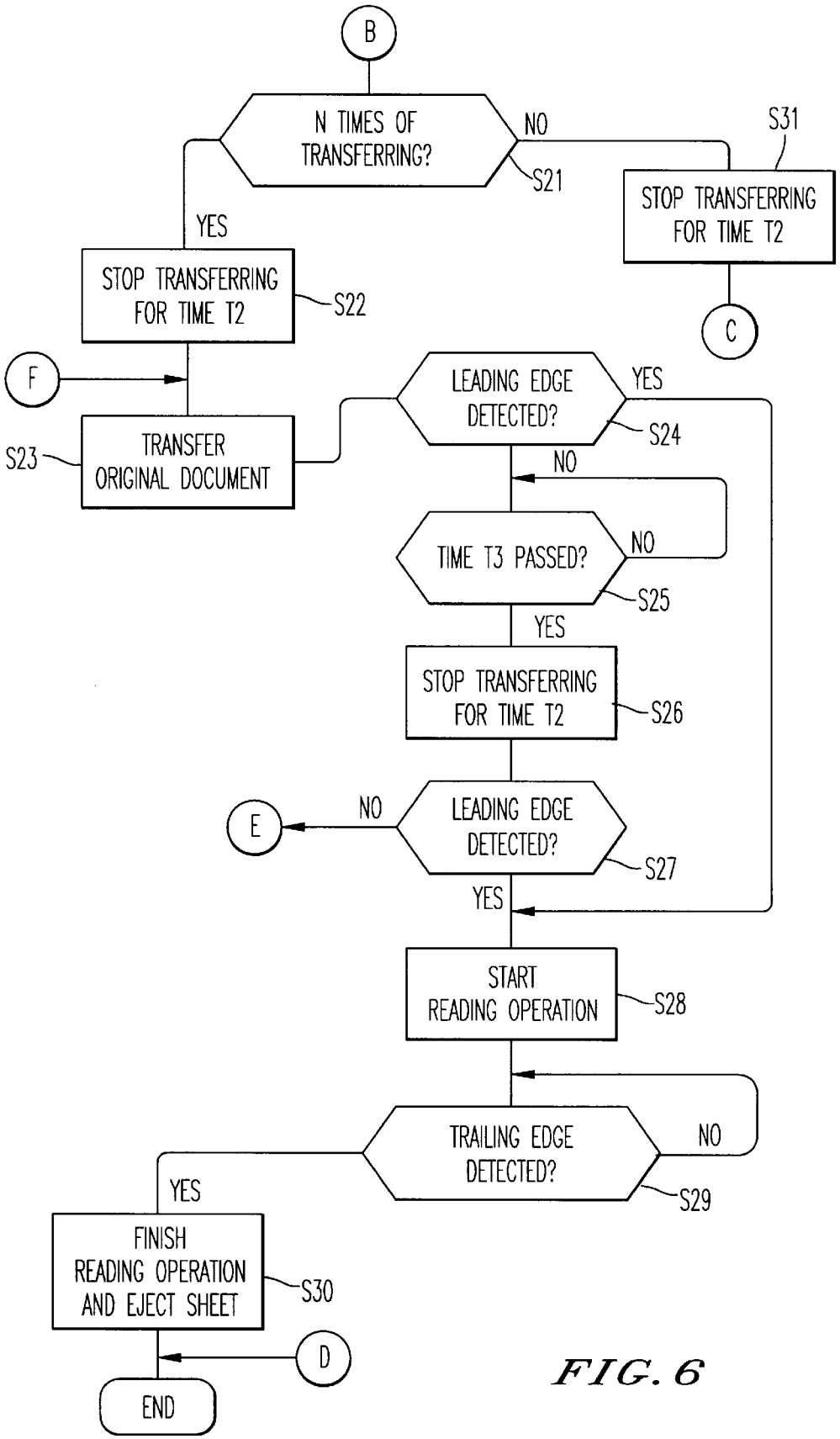
FIG. 6 is a flowchart that describes an alternate embodiment of present invention.
Figure 8A:
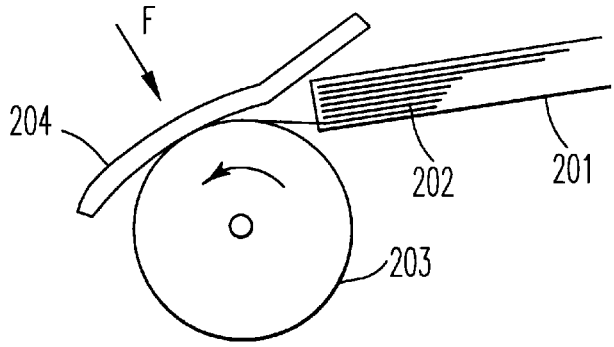
FIGS. 8(*a*)–8(*c*) are illustrations of background art friction paper feeding units.
Figure 8B:
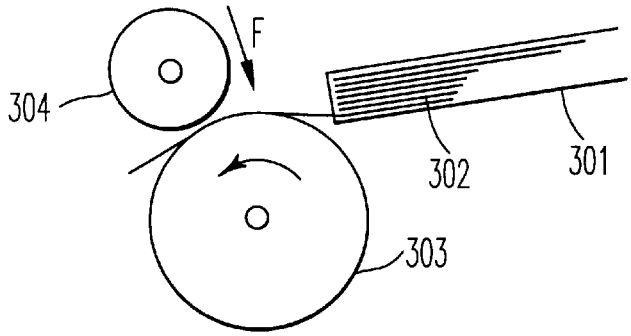
Figure 8C:
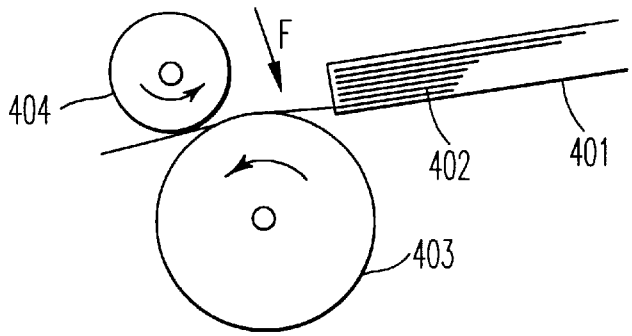
Figure 9A:
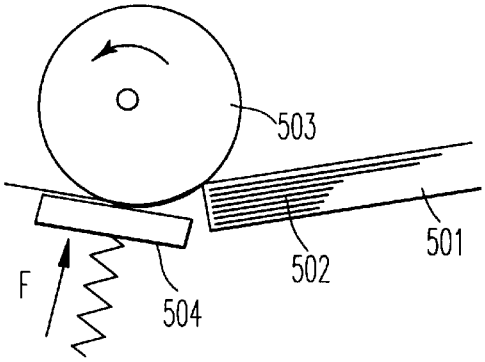
FIGS. 9(*a*)–9(*c*) are illustrations of background art friction paper feeding units.
Figure 9B:
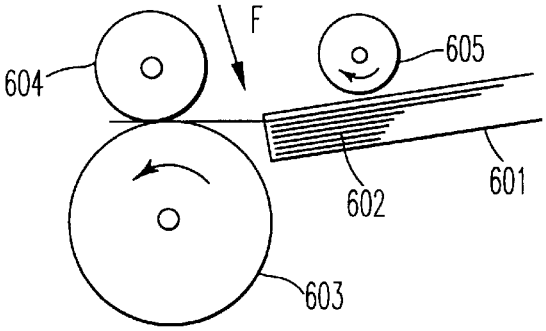
Figure 9C:
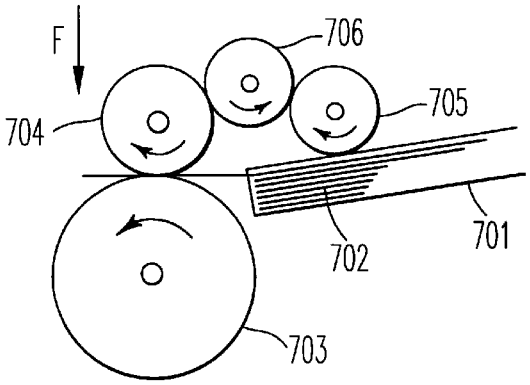

Next, how the sheet 3*a* of the original document 3 is transferred in a reading operation of the facsimile apparatus 100 including another embodiment of the friction paper-feed apparatus 1 is explained with reference to FIGS. 4, 5(*a*)–5(*b*), 6, and 7. The flow of this embodiment is similar to that of the other embodiment mentioned earlier with reference to FIGS. 4, and 5(*a*)–5(*b*), except for a case in which a judgment result becomes NO in Step S7 in FIG. 4. Therefore, an explanation is started from such a case presuming that the response to the inquiry in Step S7 is NO, where the process then proceeds to Step S21 as indicated by the symbol "B" in FIGS. 4 and 6.

In Step S21, the CPU 24 checks whether or not a number of repeat times of the transferring operation using the first predetermined time period $T_1$ becomes greater than a predetermined number of times stored in the RAM 26. If the response to the inquiry is YES in Step S21, the process proceeds to Step S22 where the CPU 24 instructs the paper-feed motor 15 to stop the first friction paper-feed roller 7 for the second predetermined time period $T_2$. Then, the CPU 24 in Step S23 instructs the paper-feed motor 15 to drive the first friction paper-feed roller 7 to start rotation for a third predetermined time period $T_3$. Then, the CPU 24 in Step S24 checks whether or not the leading edge of the sheet 3*a* is detected by the leading edge detector 13*a*. If the response to the inquiry in Step S24 is YES, the process jumps to Step S28. If the response to the inquiry in Step S24 is NO, the process goes to next Step S25 in which time length $T_3$ is checked. Upon a time that the third predetermined time period $T_3$ passes as determined in Step S25, the stop operation for the second predetermined time period $T_2$ is set by the CPU 24 in Step S26.

After that, the CPU in Step S27 again checks whether or not the leading edge of the sheet 3*a* is detected by the leading edge detector 13*a*. If the response to the inquiry in Step S27 is YES, the CPU 24 executes a reading operation in Steps S28, S29, and S30 in a same manner as in the execution made in Steps S8, S9, and S10 as shown in FIG. 4. Then, the process is ends.

If the response to the inquiry in Step S21 is NO, the stop transferring operation for the time period $T_2$ is made in Step S31. Then, the process jumps to Step S3 as represented by the symbol "C" shown in FIG. 4 to repeat the same procedure of the transferring operation for the time period $T_1$ as mentioned above.

The above-mentioned may be a case when at least one time of an execution of the transferring operation for the time period $T_1$ may not succeed to properly transfer the sheet 3*a* and an additional execution of the transferring operation for the time period $T_3$ properly may carry out the transferring operation.

Figure 7:
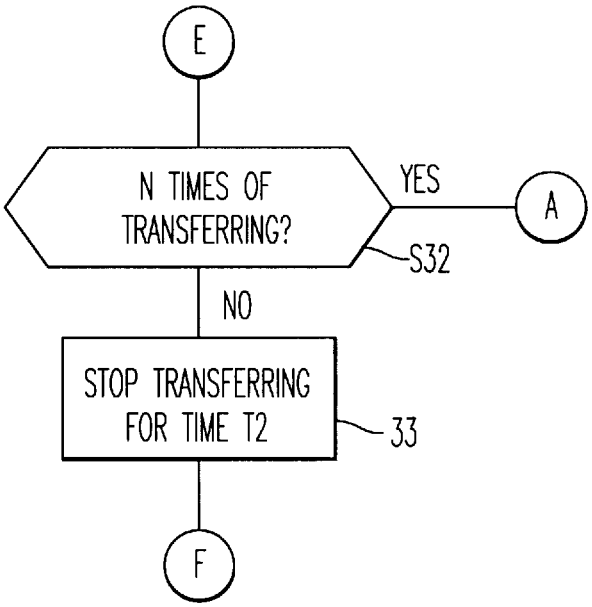
FIG. 7 is a flowchart that continues from the flowchart of FIG. 6.

If the response to the inquiry in Step S27 is NO, the process proceeds, as represented by the symbol "E", to Step S32 shown in FIG. 7 in which the CPU checks whether or not a number of repeat times of the transferring operation using the predetermined time period $T_3$ becomes greater than a predetermined number of times stored in the RAM 26. If the response to the inquiry in Step S32 is YES, the CPU 24 determines that an abnormal event occurs. Then, the process jumps to Step S11 shown in FIG. 5(*a*), in which the CPU 24 instructs the display unit 34 to display a warning and an instruction for a user to take an appropriate action such as checking and resetting the original document 3 in the input paper tray 2. Then, the process ends.

If the response to the inquiry in Step S32 is NO, the stop transferring operation for the time period $T_2$ is made in Step S33. Then, the process jumps to Step S23 shown in FIG. 6, and represented by the symbol "F" to repeat the same procedure of the transferring operation for the time period $T_3$ as mentioned above.

The above-mentioned may be a case when at least one time of an execution of the transferring operation for the time period $T_1$ may not succeed to properly transfer the sheet 3*a* and at least one time of an additional execution of the transferring operation for the time period $T_3$ properly may carry out the transferring operation.

The friction paper-feed apparatus 1 may use a stepping motor for rotating the first friction paper-feed roller 7. In this case, since the stepping motor has a driving method of keeping excitation of the motor, the sheet 3*a* continues to receive a force from the paper-feed roller 7 even during the stop operation performed during the second predetermined time period $T_2$. Accordingly, when the sheet 3*a* is stuck with any obstruction in the sheet transferring path 9 and begins to slip, the sheet 3*a* may not be recovered from slipping by an execution of the stop operation performed during the second predetermined time period $T_2$. Therefore, turning off the excitation to the stepping motor may be required during each predetermined time period $T_2$ so as to recover the sheet 3*a* from the condition of the slippage.

This invention may be conveniently implemented using a conventional general purpose digital computer programmed according to the teaching of the present specification, as will be apparent to those skilled in the computer art. Appropriate software coding can readily be prepared by skilled programmers based on the teachings of the present disclosure, as will be apparent to those skilled in the software art. The present invention may also be implemented by the preparation of application specific integrated circuits or by interconnecting an appropriate network of conventional component circuits, as will be readily apparent to those skilled in the art.

Obviously, numerous additional modifications and variations of the present invention are possible in light of the above teachings. It is therefore to be understood that within the scope of the appended claims, the present invention may be practiced otherwise than as specifically described herein.

This application is based on Japanese patent application JPAP08-041658 filed in the Japanese Patent Office on Feb. 28, 1996, the entire contents of which are hereby incorporated by reference.

What is claimed as new and is desired to be secured by Letters Patent of the United States is:

1. A paper sheet transferring apparatus, comprising:

an input tray capable of holding at least one paper sheet;

separation means for separating one paper sheet from the input tray using a frictional force generated at a contact region;

transferring means for transferring said one paper sheet separated by the separation means, said contact region being between the transferring means and the paper sheet;

a paper path that connects the input tray and an exit portion and forms a route through which the paper sheet is transferred by the transferring means;

a detector mounted at a predetermined position of the paper path that detects a presence of the paper sheet when the paper sheet is transferred to the predetermined position;

a clock that measures time;

a memory that stores data of a first predetermined time period normally appropriate to transfer the paper sheet to the predetermined position, a second predetermined time period normally appropriate to release the paper sheet from a pulling force by the transferring means, and a predetermined number;

driving means for performing a first drive operation that drives the transferring means for the first predetermined time period, a second drive operation that drives the transferring means so that the paper sheet is transferred at a predetermined speed until the paper sheet is ejected from the paper path, and a stop operation that stops driving the transferring means for the second predetermined time period;

a counter that counts a number of performance times of the first drive operation; and a controller that controls an operation of the driving means when at least one paper sheet is held in the input tray, and in a first case when the detector detects a leading edge of the paper sheet during the first drive operation, and in a second case when the detector fails to detect the paper sheet in the first drive operation, in said second case said controller is configured to control the driving means to repeat performing a set of operations including the first drive operation and the stop operation until at least one of, a time, which is a third case, that the detector detects the paper sheet unless the number of performance times counted by the counter is greater than the predetermined number of times stored in the memory, and another time, which is a fourth case, that the number of performance times counted by the counter becomes greater than the predetermined number stored in the memory, wherein the controller controls the driving means to perform the stop operation and the second drive operation in the first case and the third case so the paper sheet is subjected to a predetermined process of information processing, and for generating a predetermined warning signal in the fourth case.

2. The paper sheet transferring apparatus according to claim 1, wherein the paper sheet comprises an original document having an image thereon.

3. The paper sheet transferring apparatus according to claim 1, wherein the paper sheet comprises a blank paper sheet that serves as paper on which to be printed on a printing apparatus.

4. The paper sheet transferring apparatus according to claim 1, wherein the transferring means comprises a rotatable roller.

5. The paper sheet transferring apparatus according to claim 4, wherein the driving means comprises a stepping motor and the controller is configured to inhibit an excitation current to the stepping motor during the stop operation so that the paper sheet is relieved of a force originating from the stepping motor and exerted by the rotatable roller.

6. The paper sheet transferring apparatus according to claim 1, wherein a duration of the first drive operation is less than a total duration for transferring the paper to the predetermined position so that a plurality of times of the first drive operation is normally required to transfer the paper sheet to the predetermined position.

7. The paper sheet transferring apparatus according to claim 1, wherein a duration of the stop operation is adjustable by a user in a first mode in which the duration is set according to a user input and a second mode in which the duration automatically varies as determined by said controller.

8. The paper sheet transferring apparatus according to claim 1, wherein:

said memory is configured to store data of a third predetermined time period having a shorter time period than said first predetermined time period; and said driving means is for performing a third drive operation that drives the transferring means for the third predetermined time period and for switching between said first and second drive operations as selected by a user.

9. A paper sheet transferring apparatus, comprising:

an input tray capable of holding at least one paper sheet;

a sheet separator for separating one paper sheet from the input tray;

a sheet feeder for transferring the paper sheet separated by the sheet separator using a frictional force generated at a contact region between the sheet feeder and the paper sheet;

a paper path that connects the input tray and an exit portion, and forms a route through which the paper sheet is transferred by the sheet feeder;

a detector mounted on a predetermined position of the paper path that detects the paper sheet when the paper sheet is transferred to the predetermined position;

a clock that keeps time;

a memory that stores data of a first predetermined time period normally appropriate to transfer the paper sheet to the predetermined position, a second predetermined time period normally appropriate to release the paper sheet from a pulling force by the sheet feeder, and a predetermined number;

a sheet feeder driver that drives the sheet feeder in a first drive operation for the first predetermined time period, drives the sheet feeder in a second drive operation so that the paper sheet is transferred at a predetermined speed until the paper sheet is ejected from the paper path, and stops driving the sheet feeder in a stop operation for the second predetermined time period;

a counter that counts a number of performance times of the first drive operation;

a controller that controls the sheet feeder driver to perform the drive operation when at least one paper sheet is held in the input tray, and in a first case when the detector detects a leading edge of the paper sheet during the first drive operation, and in a second case when the detector fails to detect the paper sheet in the first drive operation, in the second case the controller controls the sheet feeder driver to repeat a set of the first drive operation and the stop operation until at least one of, a time, which is a third case, that the detector detects the paper sheet unless the number of performance times counted by the counter becomes greater than the predetermined number of times stored in the memory, and another time, which is a fourth case, that the number of performance times counted by the counter becomes greater than the predetermined number stored in the memory, wherein the controller controls the sheet feeder driver to perform the stop operation and the second drive operation in the first case and the third case so the paper sheet is subjected to a predetermined process of information processing, and for generating a predetermined warning signal in the fourth case.

10. The paper sheet transferring apparatus according to claim 9, wherein the paper sheet comprises an original document having an image thereon.

11. The paper sheet transferring apparatus according to claim 9, wherein the paper sheet comprises a blank paper sheet that serves as paper on which to be printed by a printing apparatus.

12. The paper sheet transferring apparatus according to claim 9, wherein the sheet feeder comprises a rotatable roller.

13. The paper sheet transferring apparatus according to claim 12, wherein the sheet feeder driver comprises a stepping motor and the controller is configured to inhibit an excitation current to the stepping motor during the stop operation so that so that the paper sheet is relieved of a force originating from the stepping motor and exerted by the rotatable roller.

14. The paper sheet transferring apparatus according to claim 9, wherein a duration of the first drive operation is less than a total duration for transferring the paper to the predetermined position so that a plurality of times of the first drive operation is normally required to transfer the paper sheet to the predetermined position.

15. The paper sheet transferring apparatus according to claim 9, wherein a duration of the stop operation is adjustable by a user in a first mode in which the duration is set according to a user input and a second mode in which the time length automatically varies as determined by said controller.

16. The paper sheet transferring apparatus according to claim 9, wherein:

said memory stores data of a third predetermined time period having a shorter time length than said first predetermined time period;

said sheet feeder driver further performs a third drive operation that drives the sheet feeder for the third predetermined time period; and said controller is configured to switch said sheet feeder driver between said first and second drive operations as selected by a user.

17. A facsimile apparatus, comprising:

a communications device configured to transmit and receive facsimile data; and a paper sheet transferring apparatus, comprising, an input tray capable of holding at least one paper sheet, a sheet separator for separating one paper sheet from the input tray, a sheet feeder for transferring the paper sheet separated by the sheet separator using a frictional force generated at a contact region between the sheet feeder and the paper sheet, a paper path that connects the input tray and an exit portion, and forms a route through which the paper sheet is transferred by the sheet feeder, a detector mounted on a predetermined position of the paper path that detects the paper sheet when the paper sheet is transferred to the predetermined position, a clock that keeps time, a memory that stores data of a first predetermined time period normally appropriate to transfer the paper sheet to the predetermined position, a second predetermined time period normally appropriate to release the paper sheet from a pulling force by the sheet feeder, and a predetermined number, a sheet feeder driver that drives the sheet feeder in a first drive operation for the first predetermined time period, drives the sheet feeder in a second drive operation so that the paper sheet is transferred at a predetermined speed until the paper sheet is ejected from the paper path, and stops driving the sheet feeder in a stop operation for the second predetermined time period, a counter that counts a number of performance times of the first drive operation, a controller that controls the sheet feeder driver to perform the drive operation when at least one paper sheet is held in the input tray, and in a first case when the detector detects a leading edge of the paper sheet during the first drive operation, and in a second case when the detector fails to detect the paper sheet in the first drive operation, in the second case the controller controls the sheet feeder driver to repeat a set of the first drive operation and the stop operation until at least one of, a time, which is a third case, that the detector detects the paper sheet unless the number of performance times counted by the counter becomes greater than the predetermined number of times stored in the memory, and another time, which is a fourth case, that the number of performance times counted by the counter becomes greater than the predetermined number stored in the memory, wherein the controller controls the sheet feeder driver to perform the stop operation and the second drive operation in the first case and the third case so the paper sheet is subjected to a predetermined process of information processing, and for generating a predetermined warning signal in the fourth case.

18. The facsimile apparatus according to claim 17, wherein the sheet feeder comprises a rotatable roller.

19. The facsimile apparatus according to claim 18, wherein the sheet feeder driver comprises a stepping motor and the controller is configured to inhibit an excitation current to the stepping motor during the stop operation so that so that the paper sheet is relieved of a force originating from the stepping motor and exerted by the rotatable roller.

20. The facsimile apparatus according to claim 17, wherein a duration of the first drive operation is less than a total duration for transferring the paper to the predetermined position so that a plurality of times of the first drive operation is normally required to transfer the paper sheet to the predetermined position.

21. The facsimile apparatus according to claim 17, wherein a duration of the stop operation is adjustable by a user in a first mode in which the duration is set according to a user input and a second mode in which the time length automatically varies as determined by said controller.

22. The facsimile apparatus according to claim 17, wherein:

said memory stores data of a third predetermined time period having a shorter time length than said first predetermined time period;

said sheet feeder driver further performs a third drive operation that drives the sheet feeder for the third predetermined time period; and said controller is configured to switch said sheet feeder driver between said first and second drive operations as selected by a user.

23. A method of transferring a paper sheet by a paper sheet transferring apparatus, comprising steps of:

detecting an existence of at least one paper sheet in an input paper tray;

separating the at least one paper sheet from the input tray;

activating a sheet feeder to transfer the at least one paper sheet that was separated from the input tray in said separating step through a paper path that connects the input tray and an exit portion of the paper sheet transferring apparatus and which forms a route through which the paper sheet is transferred by the sheet feeder using a frictional force generated at a contact region between the sheet feeder and the paper sheet;

detecting the paper sheet when the paper sheet is transferred to a predetermined position by a detector mounted on the predetermined position of the paper path;

keeping time by a clock;

storing in a memory data of a first predetermined time period normally appropriate to transfer the paper sheet to the predetermined position, a second predetermined time period normally appropriate to release the paper sheet from a pulling force by the sheet feeder, and a predetermined number;

activating a sheet feeder driver comprising, performing a first drive operation in which the sheet feeder drives the sheet feeder for the first predetermined time period, performing a second drive operation comprising driving the sheet feeder and transferring the paper sheet at a predetermined speed until the paper sheet is ejected from the paper path, and performing a stop operation that stops driving the sheet feeder for the second predetermined time period;

counting a number of performance times of the first drive operation by a counter; and controlling the sheet feeder driver when at least one paper sheet is held in the input tray and in a first case when the detector detects a leading edge of the paper sheet during the first drive operation, and a second case when the detector fails to detect the paper sheet in the first drive operation, said controlling step comprising controlling in the second case the sheet feeder driver to repeat a set of the first drive operation and the stop operation until at least one of, a time, which is a third case, that the detector detects the paper sheet unless the number of performance times counted by the counter becomes greater than the predetermined number of times stored in the memory, and another time, which is a fourth case, that the number of performance times counted by the counter becomes greater than the predetermined number stored in the memory, and controlling the sheet feeder driver to perform the stop operation and the second drive operation in the first case and the third case so the paper sheet is subjected to a predetermined process of information processing, and generating a predetermined warning signal in the fourth case.

24. The method according to claim 23, wherein the detecting step comprises detecting an existence of the at least one paper sheet which comprises an original document having an image thereon.

25. The method according to claim 23, wherein the detecting step comprises detecting an existence of the at least one paper sheet which comprises a blank paper sheet that serves as paper to be printed by a printing apparatus.

26. The method according to claim 23, wherein the activating a sheet feeder step comprises activating the sheet feeder which comprises a rotatable roller.

27. The method according to claim 26, wherein:

the activating a sheet feeder driver step comprises activating the sheet feeder driver which comprises a stepping motor; and the controlling the sheet feeder driver step comprises inhibiting an excitation current to the stepping motor during the stop operation so that the paper sheet is relieved from a force originating from the stepping motor and exerted through the rotatable roller.

28. The method according to claim 23, wherein the activating a sheet feeder driver step comprises activating the sheet feeder driver for a duration of the first drive operation that is less than a total duration for transferring the paper to the predetermined position so that a plurality of times of the first drive operation is normally required to transfer the paper sheet to the predetermined position.

29. The method according to claim 23, wherein the activating a sheet feeder driver step comprises stopping the sheet feeder driver in the stop operation for a duration that is adjustable by a user in a first mode in which the duration is set according to a user input and another mode in which the duration automatically varies as determined by a controller.

30. The method according to claim 23, wherein:

said step of storing data comprises storing data of a third predetermined time period having a shorter time length relative to said first predetermined time period;

said step of activating said sheet feeder driver further comprises activating said sheet feeder driver to perform a third drive operation in which the sheet feeder driver drives the sheet feeder for the third predetermined time period; and said step of controlling further comprises switching between said first and second drive operations as selected by a user.

* * * * *